US007831170B2

(12) United States Patent
Hasegawa

(10) Patent No.: US 7,831,170 B2
(45) Date of Patent: Nov. 9, 2010

(54) TONER CARTRIDGE AND IMAGE FORMING APPARATUS

(75) Inventor: Mitsuhiro Hasegawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 106 days.

(21) Appl. No.: 12/153,002

(22) Filed: May 12, 2008

(65) Prior Publication Data

US 2008/0298834 A1 Dec. 4, 2008

(30) Foreign Application Priority Data

Jun. 1, 2007 (JP) ..... 2007-147081

(51) Int. Cl.
*G03G 15/08* (2006.01)

(52) U.S. Cl. ..... 399/106; 399/260

(58) Field of Classification Search ..... 399/258, 399/260, 106, 262, 120; 222/DIG. 1
See application file for complete search history.

(56) References Cited

U.S. PATENT DOCUMENTS 5,177,539 A * 1/1993 Tsuji ..... 399/281
5,235,130 A * 8/1993 Demoto et al. ..... 399/258 X
5,402,216 A * 3/1995 Komaki et al. ..... 399/260
2002/0064401 A1 * 5/2002 Ashikari ..... 399/258
2004/0161266 A1 * 8/2004 Ban et al. ..... 399/258

FOREIGN PATENT DOCUMENTS

| | | | |
|---|---|---|---|
| JP | 02-221981 | | 9/1990 |
| JP | 05-150642 | | 6/1993 |
| JP | 05-333696 | A * | 12/1993 |
| JP | 06-011967 | | 1/1994 |
| JP | 06-095506 | A * | 4/1994 |
| JP | 07-005754 | | 1/1995 |
| JP | 10-078698 | A * | 3/1998 |
| JP | 2002-244422 | | 8/2002 |
| JP | 2003-084557 | | 3/2003 |

OTHER PUBLICATIONS

Machine translation of JP 2002-244422 A dated Oct. 22, 2009.*

* cited by examiner

*Primary Examiner*—Sophia S Chen
(74) *Attorney, Agent, or Firm*—Nixon & Vanderhye P.C.

(57) ABSTRACT

In one embodiment, a toner cartridge of the invention is installed in an image forming apparatus, and includes a toner storage container that has a toner discharge port, and a toner discharge roller disposed inside of the toner storage container so as to block the toner discharge port. An inner wall of the toner storage container faced by the toner discharge roller is provided with a curved region that has a curvature that matches a curvature of the toner discharge roller.

4 Claims, 8 Drawing Sheets

TONER CARTRIDGE AND IMAGE FORMING APPARATUS

BACKGROUND OF THE INVENTION

This application claims priority under 35 U.S.C. § 119(a) on Japanese Patent Application No. 2007-147081 filed in Japan on Jun. 1, 2007, the entire contents of which are herein incorporated by reference.

An aspect of the present invention relates to a toner cartridge and an image forming apparatus.

Image forming apparatuses that form images using an electrophotographic method are capable of forming a high quality image with a simple operation, and also maintenance of such image forming apparatuses is easy, so such image forming apparatuses are becoming widespread, being used heavily in copy machines, printers, facsimile apparatuses, and the like. An electrophotographic image forming apparatus ordinarily forms an electrostatic latent image on an electrostatic latent image carrier such as a photosensitive drum, develops the electrostatic latent image with a development apparatus using a toner supplied from a toner discharge apparatus provided in the development apparatus to the development apparatus by rotation of a toner discharge roller, transfers a toner image to a recording medium such as recording paper with a transfer apparatus, and fixes the toner image on the recording medium with a fixing apparatus.

In this sort of image forming apparatus, consumed toner and recording media can be replenished by a user as necessary. Of these, toner is replenished to the toner discharge apparatus by the user, but there is the problem that because toner is made up of extremely light and fine particles, when replenishing toner to the toner discharge apparatus, toner scatters into the air and the user's hands become dirty.

As a response to this problem, a technique has recently become mainstream in which, such that toner particles do not scatter into the air, a toner cartridge having the function of a toner discharge apparatus is installed in the image forming apparatus, and the toner cartridge is exchanged as-is; that is, a toner cartridge that has become empty is removed from the image forming apparatus and a new toner cartridge is installed. Due to recent increasing awareness of environmental problems, it is often the case that the empty toner cartridge is reused and not discarded, so the empty toner cartridge is shipped after being cleaned and filled with new toner.

In this sort of toner cartridge, a toner discharge port is provided in order to discharge toner from the toner cartridge to the development apparatus. Accordingly, there is a risk that during transportation by a transportation means such as a boat or a vehicle, toner stored in the toner cartridge will leak out from the toner discharge port. Thus, conventionally, a method has been adopted in which toner leakage is prevented during transportation by plugging the toner discharge port with a heat seal. However, there is the problem that with a toner cartridge in which the toner discharge port has been heat sealed, when installing the toner cartridge in an image forming apparatus, it is necessary to remove that heat seal, and when removing the heat seal, toner scatters and hands of the user become dirty.

In order to address such a problem, in JP H6-11967A for example, a toner cartridge has been proposed in which a toner discharge roller that has a passage prevention portion of vinyl or the like that prevents passage of toner is disposed at the toner discharge port of a toner storage container. Also, JP 2003-84557A discloses a toner cartridge in which a seal member is disposed between a toner discharge roller and a toner discharge port.

However, with the toner cartridge described in JP H6-11967A and JP 2003-84557A, the case is such that during transportation by a transportation means such as a boat or a vehicle, when the toner storage container in which toner is stored receives vibration for a long period of time, or receives a large vibration, toner enters between the passage prevention portion of the toner discharge roller and the inner wall of the toner storage container, or between the seal member and the inner wall of the toner storage container, and leaks from the toner discharge port.

In this toner cartridge described in JP H6-11967A and JP 2003-84557A, in order to prevent toner leakage during transportation, it is conceivable to increase the pressing force of the toner discharge roller against the inner wall of the toner storage container, thus causing the toner discharge roller surface to fit closely to the area around the toner discharge port, but when the pressing force of the toner discharge roller is increased in this manner, frictional resistance between the toner discharge roller and the inner wall of the toner storage container becomes large when the toner discharge roller rotates in order to use the toner cartridge (that is, in order to discharge toner from the toner discharge port), and thus there is frictional wear on the toner discharge roller. Consequently, performance of the toner discharge roller decreases, and in that state it is not possible to reuse the toner cartridge.

SUMMARY OF THE INVENTION

The invention was made at least in part in view of the above conventional problems, and it is an object thereof to provide a toner cartridge, and an image forming apparatus in which that toner cartridge can be installed, in which toner leakage during transportation can be effectively prevented and workability when installing the toner cartridge in an image forming apparatus can be improved, and furthermore in which a toner discharge roller has excellent durability so that the toner cartridge can be easily reused.

In order to address the above problems, an aspect of the invention provides a toner cartridge installed in an image forming apparatus, the toner cartridge including a toner storage container that has a toner discharge port, and a toner discharge roller disposed inside of the toner storage container so as to block the toner discharge port, in which an inner wall of the toner storage container faced by the toner discharge roller is provided with a curved region that has a curvature that matches a curvature of the toner discharge roller.

The following specific embodiments can be presented as non-limiting examples of a toner cartridge according to the invention.

(a) In one embodiment, a toner cartridge is provided in which the curved region of the toner storage container, an angle $\theta$is $20° \leqq \theta \leqq 180°$, the angle $\theta$being formed by a first imaginary line that connects a curvature start position of one side in the rotation direction of the toner discharge roller with the center of rotation of the toner discharge roller, and a second imaginary line that connects a curvature end position of the other side in the rotation direction of the toner discharge roller with the center of rotation of the toner discharge roller.

(b) In another embodiment, a toner cartridge is further provided with a toner stirring member that stirs toner stored in the toner storage container, and a toner scooping blade that scoops up the toner stored in the toner storage container to the position of the toner discharge roller, in which one end of the toner scooping blade is provided with the toner stirring member, and a free end side is inserted between the curved region and the toner discharge roller so as to cover the toner discharge port, and the free end side is forcibly separated from the toner discharge port by rotation of the toner stirring member.

(c) In another embodiment, a toner cartridge is provided in which the embodiments in (a) and (b) are combined.

In another example embodiment, in the embodiment in (a), a seal member is further provided, one end of the seal member being fixed to the inner wall of the toner storage container on the downstream side in the rotation direction of the toner discharge roller using the toner discharge port as a reference, and a free end side being inserted between the curved region and the toner discharge roller so as to cover the toner discharge port, and the free end side of the seal member is separated from the toner discharge port by rotation of the toner discharge roller. In this embodiment, in the toner storage container, the inner wall on the upstream side in the rotation direction of the toner discharge roller from the curvature start position may protrude in the direction away from the toner discharge roller. Also, in addition to or instead of this configuration, it is preferable to adopt a configuration in which the seal member is disposed in a state folded back in the inner wall of the toner storage container, and after the free end side of the seal member is evacuated from the toner discharge port by rotation of the toner discharge roller and released to the outside from between the inner wall of the toner storage container and the toner discharge roller, the seal member is in a state of being not folded back.

In any case, the seal member can, for example, be made of urethane rubber with a thickness of not less than 0.125 mm and not more than 0.2 mm.

In the toner cartridge according to an aspect of the invention, it is preferable that the toner discharge roller, or at least the surface of the toner discharge roller is formed of a foam elastomer.

An image forming apparatus is provided in which the above toner cartridge according to the invention can be installed, the image forming apparatus including: an electrostatic latent image carrier on whose surface an electrostatic latent image is formed, a charging apparatus that charges the surface of the electrostatic latent image carrier, an exposure apparatus that forms an electrostatic latent image on the surface of the electrostatic latent image carrier, a development apparatus that supplies a toner to an electrostatic latent image on the surface of the electrostatic latent image carrier to form a toner image, a transfer apparatus that transfers a toner image on the surface of the electrostatic latent image carrier to a recording medium, a cleaning apparatus that cleans the surface of the electrostatic latent image carrier, and a fixing apparatus that fixes a toner image to a recording medium, in which the image forming apparatus forms an image using an electrophotographic method.

BRIEF DESCRIPTION OF THE DRAWINGS

FIG. 2A shows one embodiment of a curved region, FIG. 2B shows another embodiment of the curved region, and FIG. 2C shows still another embodiment of the curved region.

FIG. 3A shows the state of a seal member before the toner cartridge is installed in an image forming apparatus, or before rotation of the toner discharge roller in a state in which the toner cartridge has been installed in an image forming apparatus. FIG. 3B shows the state of the seal member after rotation of the toner discharge roller in a state in which the toner cartridge has been installed in the image forming apparatus.

FIG. 5A shows the state of a seal member before the toner cartridge is installed in an image forming apparatus, or before rotation of the toner discharge roller in a state in which the toner cartridge has been installed in an image forming apparatus. FIG. 5B shows the state of the seal member after rotation of the toner discharge roller in a state in which the toner cartridge has been installed in the image forming apparatus.

DESCRIPTION OF THE PREFERRED EMBODIMENTS

Figure 1:
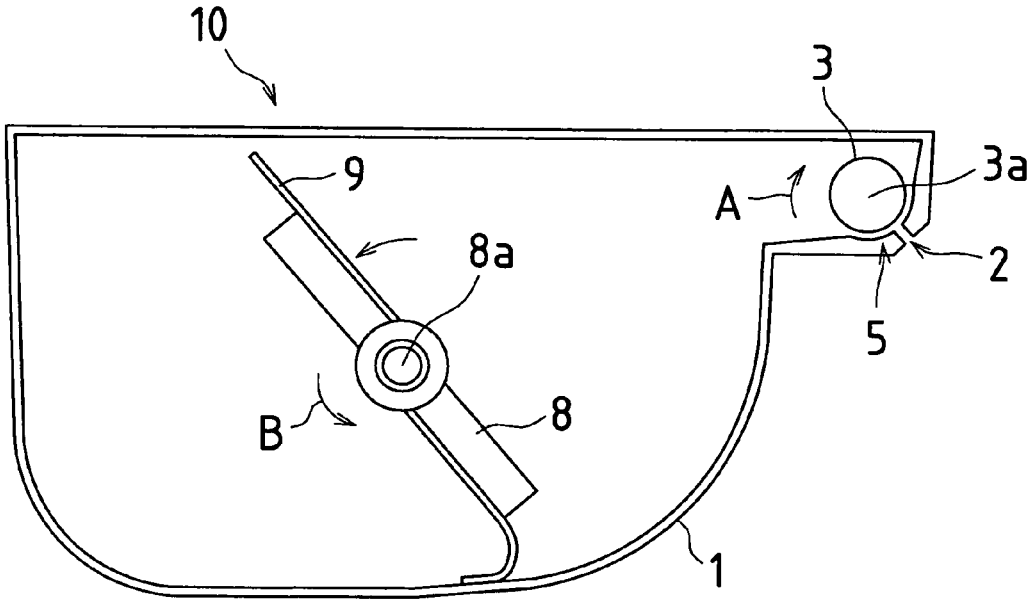
FIG. 1 is a cross-sectional view that schematically shows the configuration of a toner cartridge that is an embodiment of the invention.

Hereinafter, a toner cartridge according to an embodiment of the present invention will be described with reference to the accompanying drawings. FIG. 1 is a cross-sectional view that schematically shows the configuration of a toner cartridge that is an embodiment of the invention.

As shown in FIG. 1, a toner cartridge 10 is provided with a toner storage container 1 and a toner discharge roller 3. The toner storage container 1 has a toner discharge port 2 in communication with a development tank 11 in a development apparatus 20 of an image forming apparatus 30 in which the toner cartridge 10 can be installed (see FIG. 8, described below). The toner discharge roller 3 is provided at a position that blocks the toner discharge port 2 on the inside of the toner storage container 1. The image forming apparatus 30 is configured so as to rotate the toner discharge roller 3 in one direction (direction A in FIG. 1).

Also, the inner wall of the toner storage container 1 faced by the toner discharge port 2 is provided with a curved region 5 that has a curvature that matches a curvature of the toner discharge roller 3. The toner discharge roller 3 is disposed in contact with the curved region 5 of the toner storage container 1. That is, the toner discharge roller 3 is rotatably disposed in the toner storage container such that the center of rotation of the toner discharge roller 3 matches the center of curvature of the curved region of the toner storage container 1. Also, in FIG. 1, in order for the configuration to be more easily understood, a gap is shown between the toner discharge roller 3 and the curved region 5, but actually the surface of the toner discharge roller 3 and the curved region 5 are in a state of contact.

In this manner, in the toner cartridge 10 according to this embodiment of the invention, the inner wall of the toner storage container 1 is provided with the curved region 5 having a curvature that matches the curvature of the toner discharge roller 3. Thus, because it is possible to increase the contact area of the surface of the toner discharge roller 3 and the inner wall of the toner storage container (that is, the curved region 5), even during transportation in which a violent shock or vibration for a long period of time is received, it is possible to make it difficult for toner to move between the toner discharge roller 3 and the inner wall of the toner storage container 1 to the toner discharge port 2. Also, with this configuration it is possible to effectively prevent toner leakage from the toner discharge port 2.

Next is a more specific description of the toner cartridge 10 shown in FIG. 1. This toner cartridge 10 is provided with a toner stirring member 8 and a toner scooping blade 9.

The toner storage container 1, here, is a container member with approximately a half-cylindrical shape having an internal space. The toner storage container 1 rotatably supports the toner stirring member 8 and the toner discharge roller 3, with rotational axis lines 8*a* and 3*a* as centers of rotation, and stores toner.

Here, the toner discharge port 2 is an opening portion with approximately a rectangular shape whose long sides are in the axial direction of the toner discharge roller 3. The toner discharge port 2 is formed at a position where, when the toner cartridge 10 has been installed in the image forming apparatus 30, the toner discharge port 2 faces the development tank 11 of the development apparatus 20 provided in the image forming apparatus 30. The toner stirring member, by rotating with the rotational axis line 8*a* as the center of rotation, stirs toner stored within the toner storage container 1.

The toner scooping blade 9 is a plate-like member whose long direction extends in the axis line direction of the toner stirring member 8. The toner scooping blade 9 is provided at an outside end portion in the radial direction of the toner stirring member 8, in order to scoop up toner within the toner storage container 1 and transport that toner to the toner discharge roller 3. The toner scooping blade 9 is preferably constituted from a flexible material (for example, a polyethylene terephthalate (PET) sheet). In this case, when the toner scooping blade 9 has scooped up toner towards the toner discharge roller 3, due to the flexibility of the toner scooping blade 9, the toner scooping blade 9 rotates while sliding against the inner wall of the toner storage container 1 and deforming, and thus toner can be effectively supplied to the toner discharge roller 3.

The toner discharge roller 3, due to its own rotation, guides toner that is transported by the toner scooping blade 9 to the toner discharge port 2, and supplies that toner from the toner discharge port 2 to the development tank 11. Thus, during transportation, the toner discharge port 2 is obstructed from the inside of the toner cartridge 10, and therefore toner leakage from the toner discharge port 2 is prevented. On the other hand, with the toner cartridge 10 installed in the image forming apparatus 30, by rotating the toner discharge roller 3 in the direction of arrow A, toner transported by the toner scooping blade 9 is guided to the toner discharge port 2. Thus, toner can be discharged from the toner discharge port 2 to the development tank 11.

Figure 2A:
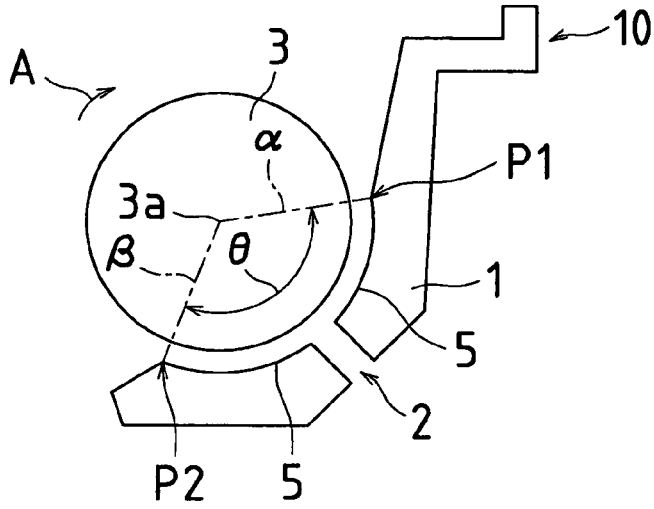
FIGS. 2A to 2C are enlarged views of a portion of the toner cartridge shown in FIG. 1 that is in the vicinity of a toner discharge roller.
Figure 2B:
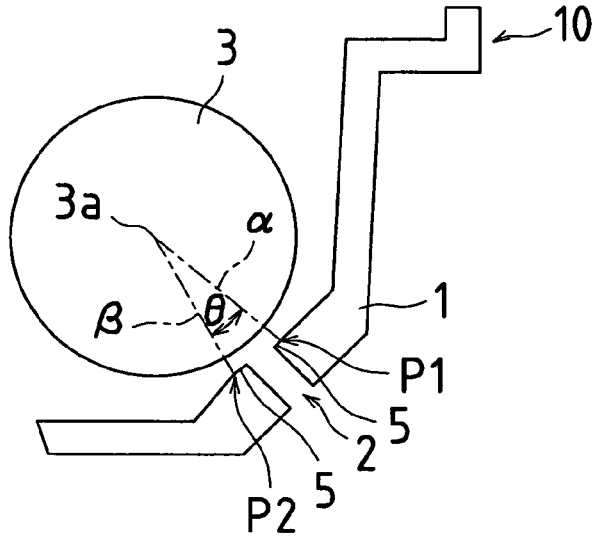
Figure 2C:
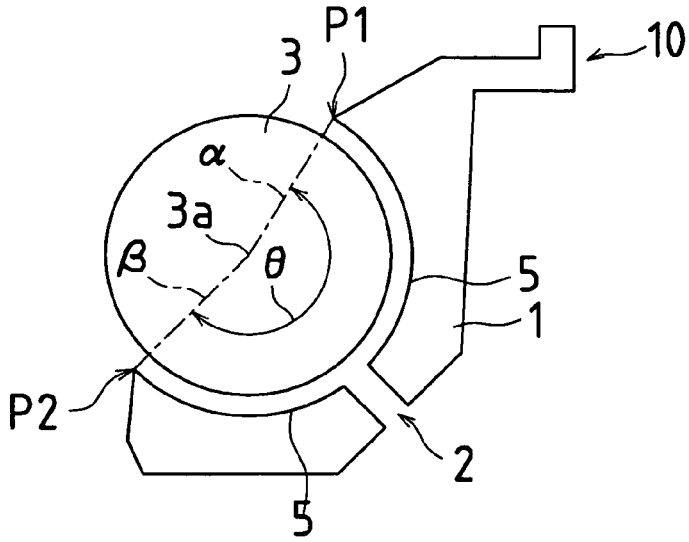

FIGS. 2A to 2C are enlarged views of a portion of the toner cartridge 10 shown in FIG. 1 that is in the vicinity of the toner discharge roller 3. FIG. 2A shows one embodiment of the curved region 5, FIG. 2B shows another embodiment of the curved region 5, and FIG. 2C shows still another embodiment of the curved region 5.

In the embodiment of the toner cartridge 10 shown in FIG. 2A, a configuration is adopted such that the relationship $20° \leqq \theta \leqq 180°$ is satisfied, where $\theta$ is an angle formed by a first imaginary line a that connects a curvature start position P1 of the inner wall of the toner storage container 1 on the upstream side in the rotation direction A of the toner discharge roller 3 with the center of rotation (rotational axis line) 3*a* of the toner discharge roller 3, and a second imaginary line $\beta$ that connects a curvature end position P2 of the inner wall of the toner storage container 1 on the downstream side in the rotation direction A of the toner discharge roller 3 with the center of rotation 3*a* of the toner discharge roller 3. By adopting such a configuration, it is possible while suppressing rotational torque of the toner discharge roller 3 to effectively prevent toner leakage from the toner discharge port 2.

On the other hand, when, as in the embodiment of the toner cartridge 10 shown in FIG. 2B, a configuration is adopted such that the angle $\theta$ satisfies the relationship $\theta<20°$, the contact area of the surface of the toner discharge roller 3 and the inner wall of the toner storage container (the curved region 5) is reduced, likely resulting in toner leakage from the toner discharge port 2. Also, when, as in the embodiment of the toner cartridge 10 shown in FIG. 2C, a configuration is adopted such that the angle $\theta$ satisfies the relationship $\theta>180°$, the contact area of the surface of the toner discharge roller 3 and the inner wall of the toner storage container (the curved region 5) is increased, so frictional resistance easily increases, likely resulting in increased rotational torque of the toner discharge roller 3.

Figure 3A:
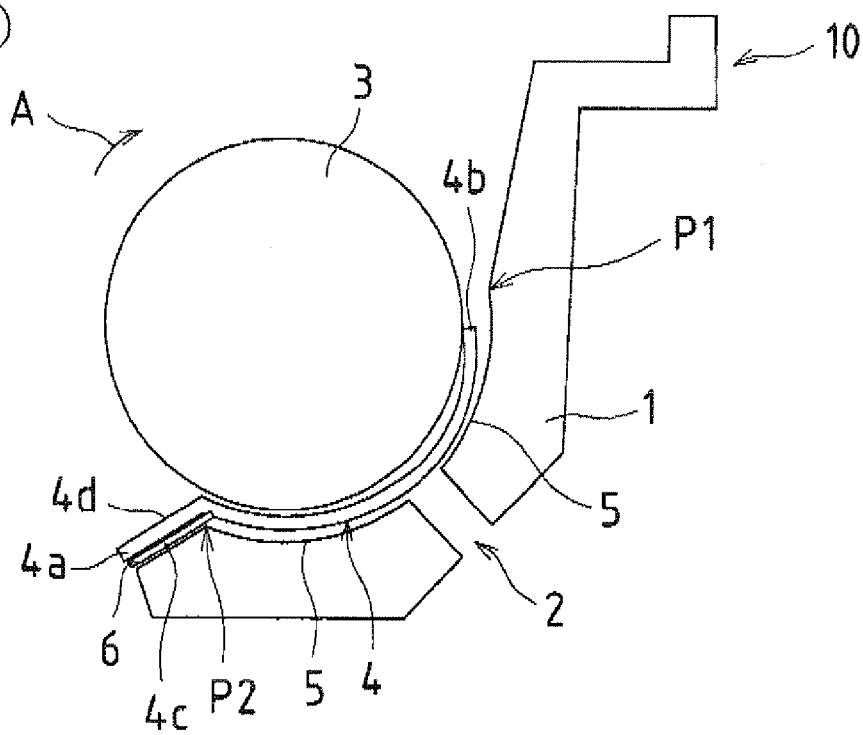
FIGS. 3A and 3B are enlarged views of a portion of the toner cartridge shown in FIG. 1 that is in the vicinity of a toner discharge roller according to another embodiment.
Figure 3B:
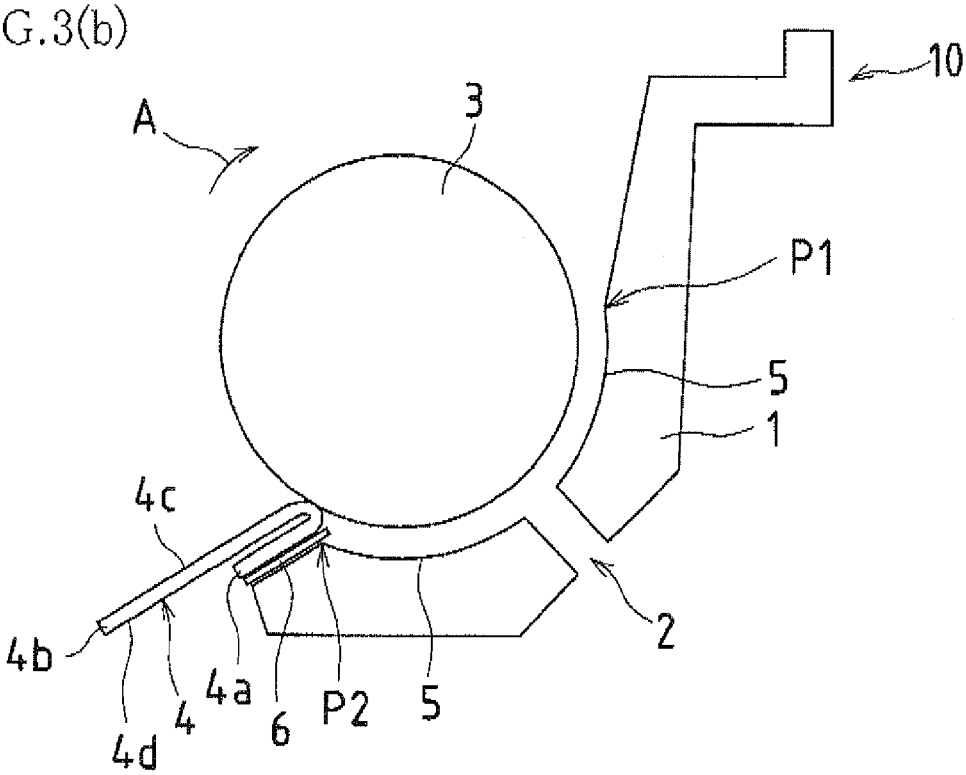

The toner cartridge 10 may be further provided with a seal member 4. FIGS. 3A and 3B are enlarged views of a portion of the toner cartridge 10 shown in FIG. 1 that is in the vicinity of the toner discharge roller 3 according to another embodiment. FIG. 3A shows the state of the seal member 4 before the toner cartridge 10 is installed in the image forming apparatus 30 (an initial state such as during transportation), or the state of the seal member 4 before rotation of the toner discharge roller 3 in a state in which the toner cartridge 10 has been installed in the image forming apparatus 30. FIG. 3B shows the state of the seal member 4 after rotation of the toner discharge roller 3 in a state in which the toner cartridge 10 has been installed in the image forming apparatus 30 (a state in which the toner discharge port 2 is open).

As shown in FIG. 3A, in the initial state, in the seal member 4, one end portion 4*a* is fixed to the inner wall of the toner storage container 1 in the vicinity of the curved region 5 on the downstream side in the rotation direction A of the toner discharge roller 3 from the toner discharge port 2, and a free end side 4*b* is inserted between the curved region 5 and the toner discharge roller 3 so as to block the toner discharge port 2. Furthermore, in this configuration, after the toner cartridge 10 has been installed in the image forming apparatus 30, due to rotation of the toner discharge roller 3, the free end side 4*b* of the seal member 4 disposed in contact with the surface of the toner discharge roller 3 easily separates from the toner discharge port 2 due to the force of friction with the surface of the toner discharge roller 3. With a toner cartridge 10 provided with this configuration, it is possible to make it more difficult for toner to enter between the seal member 4 and the inner wall of the toner storage container 1 during transportation, and thus it is possible to make it more difficult for toner leakage from the toner discharge port 2 to occur. Also, due to rotation of the toner discharge roller 3, with frictional force between the surface of the toner discharge roller 3 and the free end side 4*b* of the seal member 4, it is possible to easily remove the free end side 4*b* of the seal member 4 from the toner discharge port 2.

Specifically, the seal member 4 is disposed in a state not folded back relative to the inner wall of the toner storage container 1 (see FIG. 3A). Also, the seal member 4 is configured such that after the free end side 4*b* has separated from the toner discharge port 2 due to rotation of the toner discharge roller 3 and has been released to the outside from between the curved region 5 and the toner discharge roller 3, the seal member 4 is in a folded back state (see FIG. 3B).

Specifically, the seal member 4 is a flexible sheet-like member, and has an approximately rectangular shape with about the same width as the toner discharge roller 3 in the axial direction of the toner discharge roller 3. One face 4*c* of the one end portion 4*a* of the seal member 4 is fixed with an adhesive member 6 of double-sided tape or the like to the inner wall of the toner storage container 1 on the downstream side in the rotation direction A of the toner discharge roller 3 from the toner discharge port 2 (here, a position adjacent to the curvature end position P2 on the downstream side). Also, the free end side 4*b* of the seal member 4, so as to block the toner discharge port 2, is disposed between the curved region 5 and the toner discharge roller 3 in a state in which the free end side 4*b* is not folded back from the one end portion 4*a*, another face 4*d* on the opposite side from the one face 4*c* contacts the surface of the toner discharge roller 3, and the one face 4*c* contacts the curved region 5.

Next is a simple description of the operation of the seal member 4 and the toner discharge roller 3 in the toner cartridge 10 shown in FIG. 3A. With the toner cartridge 10 shown in FIG. 3A, in the initial state the toner discharge port 2 is blocked by the seal member 4 and the toner discharge roller 3, but the seal member 4, due to rotation of the toner discharge roller 3 (use of the toner cartridge 10), is pulled and displaced in the rotation direction A by contact resistance of the other face 4*d* with the surface of the toner discharge roller 3, so that the seal member 4 moves to a position not blocking the toner discharge port 2, and thus the toner discharge port 2 is opened. Afterward, as shown in FIG. 3B, the free end side 4*b* is released to the outside from between the curved region 5 and the toner discharge roller 3, and thus the seal member 4 is in a folded back state.

When image forming is performed, the toner stirring member 8 rotates in the direction of arrow B in FIG. 1 to stir toner, and toner is scooped up towards the toner discharge roller 3 by the toner scooping blade 9. At this time, the toner scooping blade 9, due to the flexibility of the toner scooping blade 9, rotates while sliding against the inner wall of the toner storage container 1 and deforming, and thus supplies toner to the toner discharge roller 3. The toner discharge roller 3, due to its own rotation, guides toner that has been supplied from the toner scooping blade 9 to the toner discharge port 2, thus supplying toner that has been transported between the toner discharge roller 3 and the curved region 5 from the toner discharge port 2 to the development apparatus 20.

Figure 4:
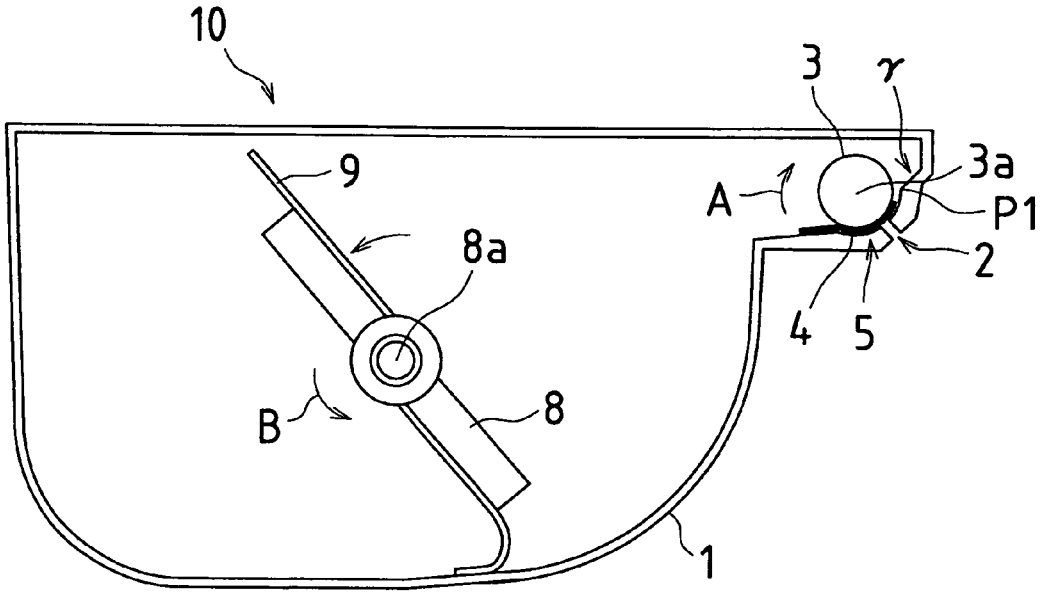
FIG. 4 is a cross-sectional view that schematically shows another example of the toner cartridge shown in FIG. 3.

Also note that with the toner cartridge shown in FIGS. 3A and 3B, from the viewpoint of adopting a configuration compatible with high-speed, high-volume printing due to accumulating a large amount of toner in the vicinity of the toner discharge roller 3, as shown in FIG. 4, it is preferable that the inner wall of the toner storage container 1 on the upstream side in the rotation direction A of the toner discharge roller 3 from the curvature start position P1 protrudes from the curvature start position P1 in the direction away from the toner discharge roller 3 (see portion γ in FIG. 4). With this toner cartridge, even if for example it is structurally more likely that toner will leak out, by providing a configuration according to an embodiment of the invention, it is possible to effectively exhibit a sealing effect.

Figure 5A:
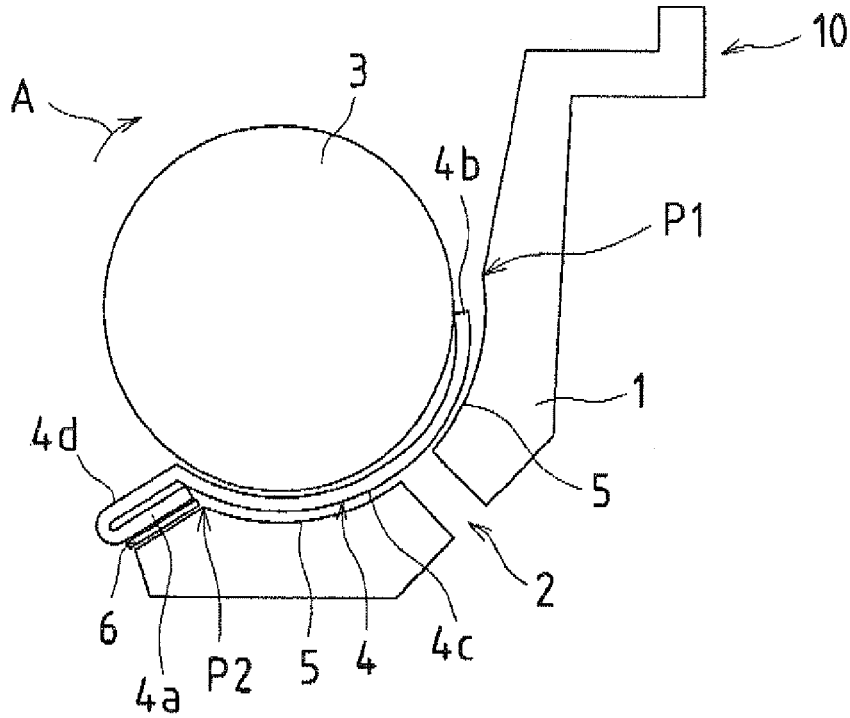
FIGS. 5A and 5B are enlarged views of a portion of another embodiment of the toner cartridge shown in FIG. 3 that is in the vicinity of a toner discharge roller.
Figure 5B:
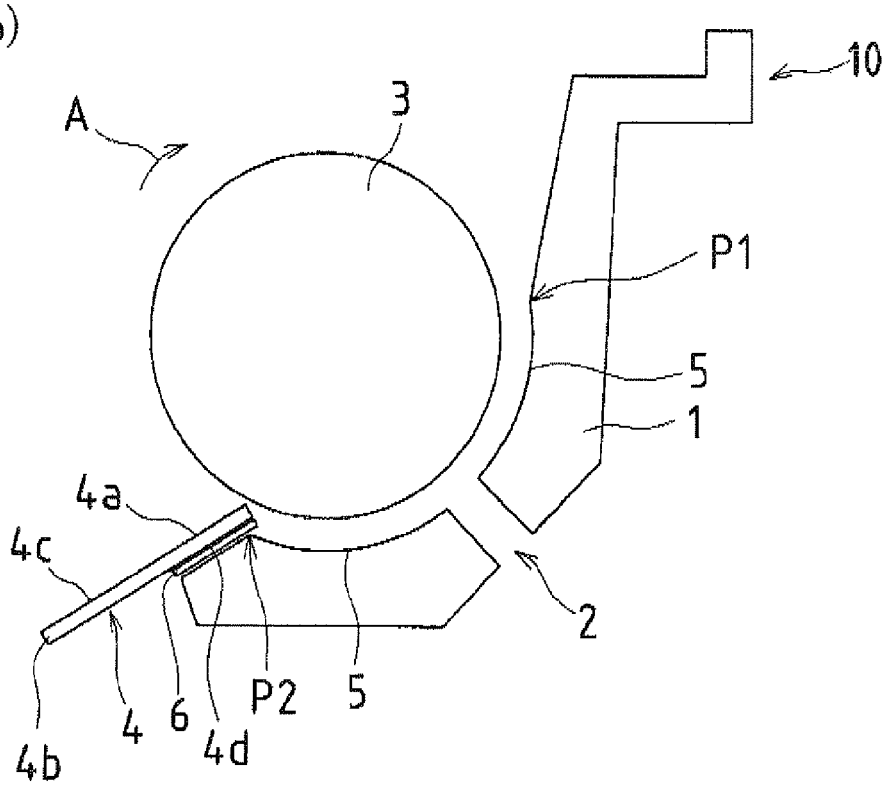

FIGS. 5A and 5B are enlarged views of a portion of another embodiment the toner cartridge 10 shown in FIG. 3 that is in the vicinity of the toner discharge roller 3. FIG. 5A shows the state of the seal member 4 before the toner cartridge 10 is installed in the image forming apparatus 30, or the state of the seal member 4 before rotation of the toner discharge roller 3 in a state in which the toner cartridge 10 has been installed in the image forming apparatus 30. FIG. 5B shows the state of the seal member 4 after rotation of the toner discharge roller 3 in a state in which the toner cartridge 10 has been installed in the image forming apparatus 30.

In the embodiment of the toner cartridge 10 shown in FIG. 5A, the same reference numerals are given to the same constituent components as shown in FIG. 3A, and a description thereof is omitted here. The seal member 4 is disposed in a state folded back relative to the inner wall of the toner storage container 1. Also, the seal member 4 is configured such that after the free end side 4*b* has separated from the toner discharge port 2 due to rotation of the toner discharge roller 3 and has been released to the outside from between the curved region 5 and the toner discharge roller 3, the seal member 4 is in a not-folded back state.

The other face 4*d* of the one end portion 4*a* of the seal member 4 is fixed with an adhesive member 6 of double-sided tape or the like to the inner wall of the toner storage container 1 on the downstream side in the rotation direction A of the toner discharge roller 3 from the toner discharge port 2 (here, a position adjacent to the curvature end position P2 on the downstream side). Also, so as to block the toner discharge port 2, the free end side 4*b* of the seal member 4 is disposed between the curved region 5 and the toner discharge roller 3 in a state in which the one end side 4*a* is folded back, the other face 4*d* contacts the surface of the toner discharge roller 3, and the one face 4*c* contacts the curved region 5. That is, the seal member 4 is fixed such that the other face 4*d* on the opposite side (the back side) of the seal member 4 shown in FIG. 3 as the one face (the adhesive face that contacts the adhesive member 6) 4*c* serves as the adhesion face. By fixing the seal member 4 at the other face 4*d*, as shown in FIG. 5B, in a state in which the toner cartridge 10 has been installed in the image forming apparatus 30, it is possible to prevent bending of the seal member 4 after the toner discharge roller 3 has rotated. As a result, friction between the seal member 4 and the toner discharge roller 3 can be reduced, and thus, it is possible to improve durability of the toner discharge roller 3 and the seal member 4. By using a member with a high degree of blockage as the seal member 4, it is possible to block even a small amount of toner from entering between the seal member 4 and the inner wall of the toner cartridge (the curved region 5), and thus it is possible to make it more difficult for toner leakage from the toner discharge to occur.

As the seal member 4, it is possible to use a flexible film-like or sheet-like member constituted from a synthetic resin material such as, for example, urethane rubber, silicone rubber, polyethylene terephthalate (PET), nylon, or polypropylene. However, it is preferable to use a material with a high friction coefficient, such that the seal member 4 is reliably released to the outside from between the curved region 5 and the surface of the toner discharge roller 3 when the toner discharge roller 3 has rotated. For example, urethane rubber with a thickness of 0.125 mm to 0.2 mm is preferable from the point of providing both an appropriate friction coefficient and reusability (durability).

Figure 6:
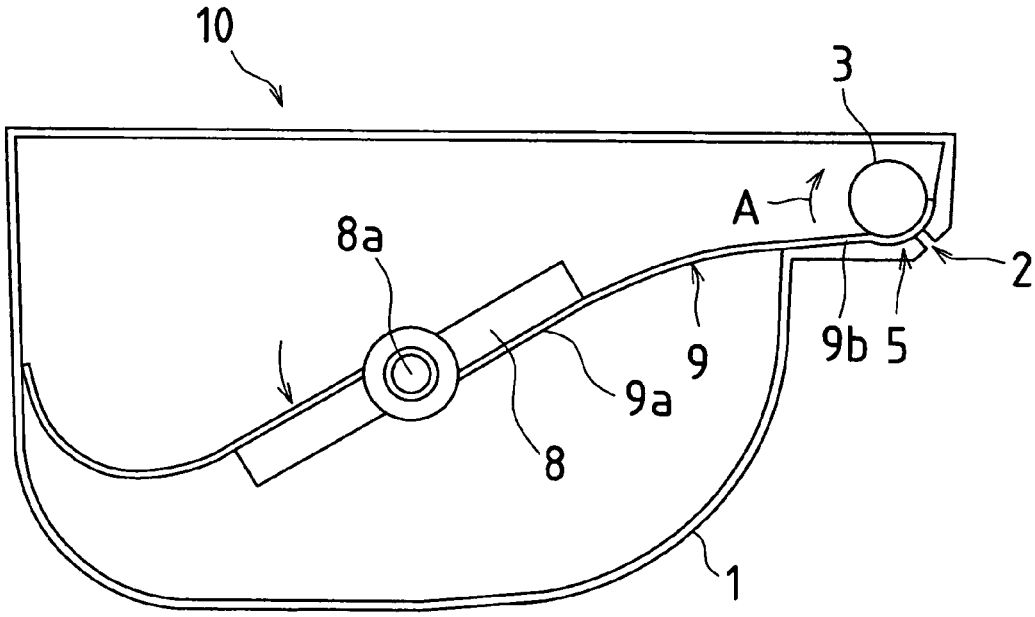
FIG. 6 is a cross-sectional view that schematically shows still another embodiment of the toner cartridge shown in FIG. 1, and shows how, before installing the toner cartridge in an image forming apparatus, in the toner cartridge, a toner scooping blade serves the role of a seal member.

FIG. 6 is a cross-sectional view that schematically shows still another embodiment of the toner cartridge 10 shown in FIG. 1, and shows how, before installing the toner cartridge 10 in the image forming apparatus 30, in the toner cartridge 10, the toner scooping blade 9 serves the role of a seal member.

In the embodiment of the toner cartridge 10 shown in FIG. 6, in the toner scooping blade 9, an end portion 9*a* is provided with the toner stirring member 8, and a free end side 9*b* is inserted between the curved region 5 and the toner discharge roller 3 so as to block the toner discharge port 2. Also, the toner scooping blade 9 is configured such that due to rotation of the toner stirring member 8, the free end side 9*b* is forcibly separated from the toner discharge port 2.

That is, in an initial state in which of the toner cartridge 10 of the embodiment shown in FIG. 6 has been installed in the image forming apparatus 30 but rotation of the toner stirring member has not yet begun, in the toner scooping blade 9, the free end side 9*b* is inserted between the curved region 5 and the toner discharge roller 3 so as to block the toner discharge port 2, and thus serves the role of a seal member as shown in FIGS. 3 and 5. Furthermore, the free end side 9*b* is forcibly separated from the toner discharge port 2 due to rotation of the stirring member 8 after the toner cartridge 10 has been installed in the image forming apparatus 30. With this configuration, separation of the seal member 4 from the discharge port 2, which relies on frictional force between the toner discharge roller 3 and the seal member 4 in the toner cartridge 10 shown in FIGS. 3 and 5, can be reliably performed by forcible movement of the free end side 9*b* of the toner scooping blade 9 due to rotation of the toner stirring member 8.

Specifically, the toner stirring member 8 is a plate-like member whose long sides extend in the direction of the rotational axis line 8*a*, and whose short sides extend on both sides in the radial direction with the rotational axis line 8*a* as a reference. The toner scooping blade 9 is provided at both ends in the radial direction of the toner stirring member 8.

The toner scooping blade 9 can be constituted from, for example, a sheet (a flexible film) made of polyethylene terephthalate (PET) that has a thickness of, for example, about 0.5 to 2 mm.

Here, the toner discharge roller 3 has a foam elastomer having elasticity in a surface layer, and specifically the surface layer is formed with a continuous foam sponge having elasticity. By providing a foam elastomer having elasticity in the surface layer of the toner discharge roller 3 in this manner, even when the free end side 4*b* of the seal member 4 or the free end side 9*b* of the toner scooping blade 9 is disposed between the toner discharge roller 3 and the curved region 5, during transportation of the toner cartridge 10 (while not yet used), it is possible to uniformly press against the curved region 5 via the free end side 4*b* of the seal member 4 or the free end side 9*b* of the toner scooping blade 9, and thus it is possible to reliably prevent toner leakage from between the free end side 4*b* or 9*b* and the curved region 5. Also, after the toner discharge roller 3 has been rotated (during use) in a state in which the toner cartridge 10 has been installed in the image forming apparatus 30, it is possible to effectively transport toner to the toner discharge port 2.

As the material of the foam elastomer, for example, it is possible to use a material such as polyurethane, silicone rubber, or ethylene-propylene rubber (EPDM). In particular, from the points of durability and toner transportability, a polyurethane foam body can be appropriately used. As the toner discharge roller 3 it is possible to appropriately use a roller in which, for example, a porous elastic body of continuous foam ester polyurethane foam (like a so-called sponge) is wrapped around a stainless steel rotating shaft.

With this sort of toner cartridge 10, the inner wall of the toner storage container 1 is provided with the curved region 5, so it is possible to increase the contact area between the toner discharge roller 3 and the inner wall of the toner storage container 1. Thus, pressing force on the inner wall of the toner storage container 1 by the toner discharge roller 3 is not increased, and when the toner discharge roller 3 is stopped (for example, during transportation), it is possible to make it difficult for toner to move between the toner discharge roller 3 and the inner wall of the toner storage container 1 to the toner discharge port 2. Accordingly, it is possible to reliably block the toner discharge port 2 without providing a heat seal that blocks the toner discharge port 2, and even if the toner cartridge 10 is kept under conditions in which vibrations are received for a long time or a large shock is received during transportation by a transportation means such as a boat or a vehicle, it is possible to effectively prevent toner leakage from the toner cartridge 10, and also, because an operation of removing a heat seal is not necessary, it is possible to improve workability when the toner cartridge 10 is installed in the image forming apparatus. Furthermore, because pressing force on the inner wall of the toner storage container 1 by the toner discharge roller 3 is not increased, when the toner cartridge is in use, it is possible to make wear of the toner discharge roller 3 more difficult to occur, so durability is excellent. Thus, it is possible to increase the number of times that the toner cartridge 10 can be reused, so reuse such as recycling or refilling can be made easier.

Figure 7:
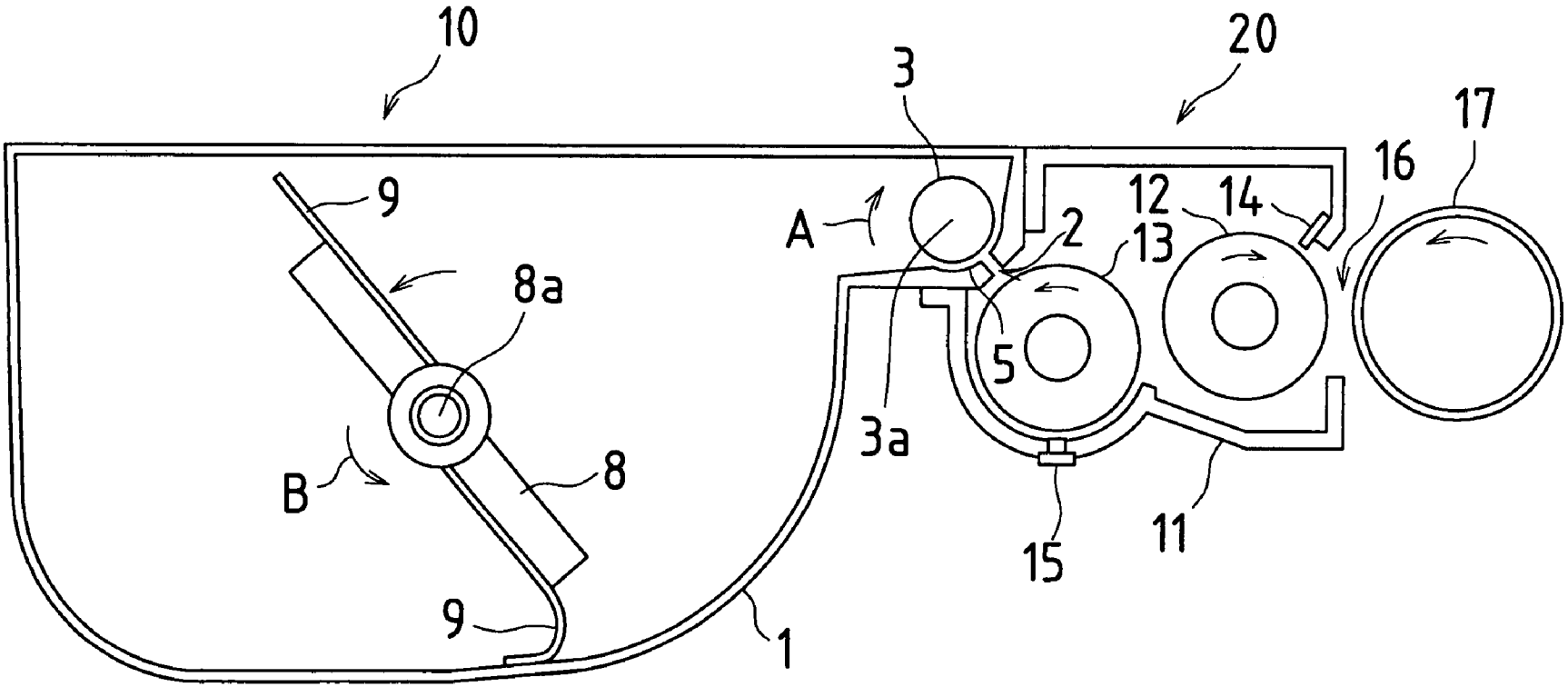
FIG. 7 is a cross-sectional view that schematically shows, in a state which the toner cartridge shown in FIG. 1 has been installed in an image forming apparatus, a portion that is in the vicinity of the toner cartridge.

FIG. 7 is a cross-sectional view that schematically shows, in a state in which the toner cartridge 10 shown in FIG. 1 has been installed in the image forming apparatus 30, a portion that is in the vicinity of the toner cartridge 10.

The toner stirring member 8 and the toner discharge roller 3 are respectively rotationally driven around the rotational axis lines 8*a* and 3*a* by driving force transmitted via a drive transmission mechanism of gears or the like from a drive source such as a drive motor, not shown.

The development apparatus 20 is provided with the development tank 11, a stirring roller 13, a development roller 12, a regulation member 14, and a toner density detection sensor 15.

The development tank 11 is a container member with approximately a half-cylindrical shape having an internal space, supports the stirring roller 13 and the development roller 12 to be capable of rotating around an axis line, and stores a two component developer in which toner and a carrier are the main components. The stirring roller 13 is rotationally driven by the unshown drive means, and thus stirs the two component developer stored within the development tank 11.

The development roller 12 is disposed facing a photosensitive drum 17 via an opening portion 16 of the development tank 11, in a state in which there is a predetermined gap relative to the photosensitive drum 17, and is rotationally driven around an axis line by the unshown drive means. Thus, the two component developer carried on the surface of the development roller 12 can be transported to the photosensitive drum (an example of an electrostatic latent image carrier) 17. Also, the two component developer transported by the development roller 12 contacts the photosensitive drum 17 at the portion of the development roller 12 that is nearest to the photosensitive drum 17 (a development nip portion). A development bias voltage is applied in the development nip portion of the development roller 12 from an unshown power source connected to the development roller 12, and thus it is possible to move the toner in the developer on the surface of the development roller 12 from the surface of the development roller 12 to an electrostatic latent image on the surface of the photosensitive drum 17.

The regulation member 14 is a plate-like member whose long direction extends in the axis line direction of the development roller 12, and whose short direction extends in the radial direction of the development roller 12. The regulation member 14 is provided in a state in which one end portion in the short direction of the regulation member 14 is supported by the development tank 11, and the other end portion in the short direction has a predetermined gap relative to the surface of the development roller 12. As the material of the regulation member 14, for example, it is possible to use stainless steel, aluminum, a synthetic resin, or the like.

The sensor face of the toner density detection sensor 15 is installed in the bottom face of the development tank 11 so as to be exposed to the inside of the development tank 11, thus facing the stirring roller 13. The toner density detection sensor 15 is electrically connected to an input system of an unshown control means.

Also, an unshown toner discharge roller drive means that rotationally drives the toner discharge roller 3 is electrically connected to an output system of the control means. The control means, according to the results of detection by the toner density detection sensor 15, is capable of rotationally driving the toner discharge roller 3 with the toner discharge roller drive means to supply toner inside of the development tank 11 via the toner discharge port 2.

When the result of detection by the toner density detection sensor 15 is judged to be lower than a toner density set value, the control means sends a control signal to the toner discharge roller drive means to rotationally drive the toner discharge roller 3. On the other hand, when the result of detection by the toner density detection sensor 15 is judged to be equal to or greater than the toner density set value, the control means stops the control signal to the toner discharge roller drive means, thus stopping rotational driving of the toner discharge roller 3.

As the toner density detection sensor 15, it is possible to use an ordinary toner density detection sensor. For example, it is possible to use a light permeability detection sensor, a reflected light detection sensor, a magnetic permeability detection sensor, or the like. Among these, it is preferable to use a magnetic permeability detection sensor.

When a magnetic permeability detection sensor is used as the toner density detection sensor 15, an unshown power source is connected to the magnetic permeability detection sensor. The power source applies a control voltage to the magnetic permeability detection sensor in order to output the results of detection of the drive voltage and the toner density to the control means. Control of voltage application to the magnetic permeability detection sensor by the power source is performed by the control means. The magnetic permeability detection sensor receives application of the control voltage and outputs the result of detecting the toner density, as an output voltage value. For the magnetic permeability detection sensor, basically a sensitivity near the center value of the output voltage is good, so a control voltage is applied such that an output voltage in that vicinity is obtained.

Figure 8:
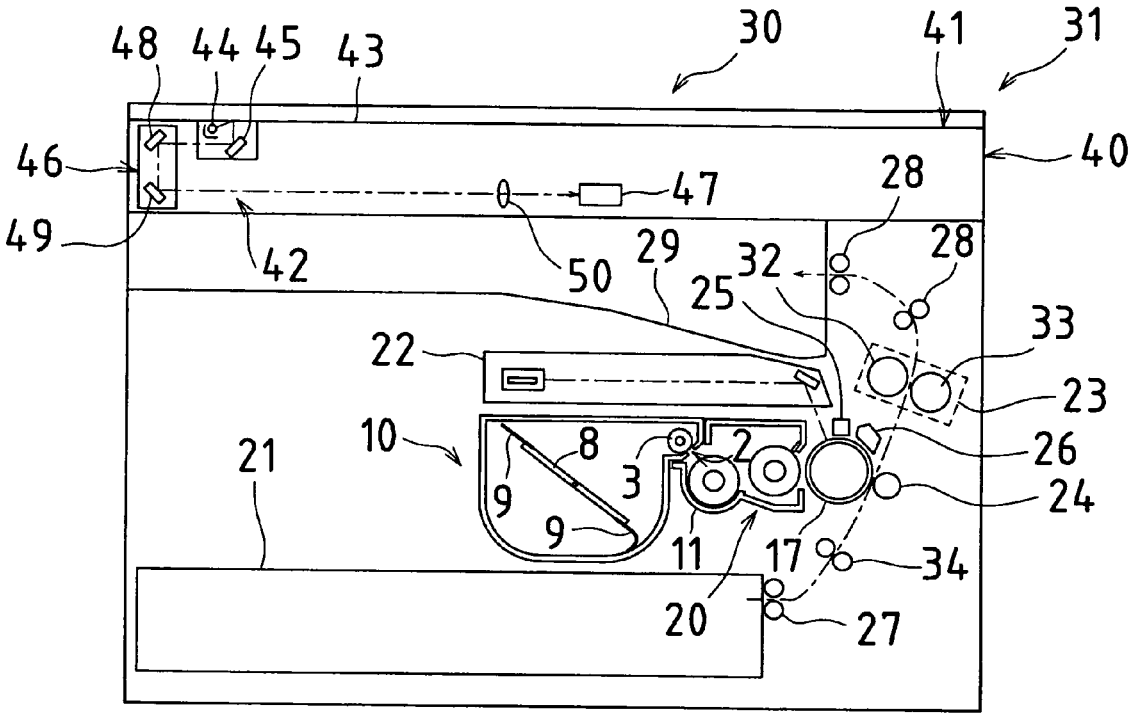
FIG. 8 is a cross-sectional view that schematically shows the configuration of an image forming apparatus in which a toner cartridge according to the invention has been installed.

FIG. 8 is a cross-sectional view that schematically shows the configuration of the image forming apparatus 30 in which the toner cartridge 10 according to an embodiment of the invention has been installed. In addition to the aforementioned development apparatus 20 and photosensitive drum 17, the image forming apparatus 30 is provided with a charging apparatus 25, an exposure apparatus 22, a cleaning apparatus 26, a transfer apparatus 24, and a fixing apparatus 23.

The photosensitive drum 17 can be rotationally driven around an axis line by an unshown drive means. The photosensitive drum 17 is a roller-like member having a photosensitive body layer on whose surface an electrostatic latent image (after development, a toner image) is formed. A representative example of the photosensitive drum 17 is a photosensitive drum that has an electrically conductive base and a photosensitive body layer formed on the surface of the electrically conductive base. Examples of the electrically conductive base, include, for example, a cylindrical, columnar, sheet-like, or other such electrically conductive base, and of those, it is preferable to use a cylindrical electrically conductive base. As the photosensitive body layer, for example, it is possible to use an organic photosensitive body layer, an inorganic photosensitive body layer, or the like.

Examples of an organic photosensitive body layer include a stacked photosensitive body layer in which a charge generating layer that is a resin layer including a charge generating substance, and a charge transportation layer that is a resin layer including a charge transportation substance, are stacked, or a simple photosensitive body layer in which a charge generating substance and a charge transportation substance are included in a single resin layer.

Examples of an inorganic photosensitive body layer include, for example, a material that includes one or two or more types of materials selected from among zinc oxide, selenium, amorphous silicon, or the like. An undercoating may be interposed between the electrically conductive base and the photosensitive body layer, and a surface coating (protective coating) mainly for protecting the photosensitive body layer may be provided on the surface of the photosensitive body layer.

Here, the charging apparatus 25 is a sawtooth charging device that performs corona discharge on the photosensitive drum 17. An unshown power source that applies voltage to the charging apparatus 25 is connected to the charging apparatus 25. The charging apparatus 25 receives application of voltage from the power source, and charges the surface of the photosensitive drum 17 to a predetermined potential of a predetermined polarity. As a charging apparatus other than a sawtooth charging device, for example, it is possible to use a contact-type charging device or the like, such as a charger-type charging device, a charging brush-type charging device, a roller-like charging device, or a magnetic brush.

In the exposure apparatus 22, image information of an original captured with a scanner unit 31 described later, or image information from an external device, is input, and signal light corresponding to the image information is irradiated to the surface of the photosensitive drum 17 in a charged state. Thus, on the surface of the photosensitive drum 17, it is possible to form an electrostatic latent image corresponding to the image information. As the exposure apparatus 22, it is possible to use, for example, a laser scanning apparatus having a light source. The laser scanning apparatus typically can be an apparatus in which are combined a light source, a polygon mirror, an fθ lens, and reflecting mirrors. As the light source, for example, it is possible to use a conductor laser, an LED array, an electroluminescence (EL) element, or the like.

The transfer apparatus 24 is provided with a roller-like member. The roller-like member is supported so as to be rotatable around an axis line by an unshown support member. Also, the roller-like member is provided so as to press against the photosensitive drum 17, and is rotationally driven by an unshown drive means. As this roller-like member, it is possible to use, for example, a roller having a metal core with a diameter of 8 to 10 mm, and an electrically conductive elastic layer formed on the surface of the metal core. As the metal that constitutes the metal core, it is possible to use, for example, stainless steel, aluminum, or the like. As the electrically-conductive elastic layer, it is possible to use, for example, a material in which a conductive material such as carbon black is blended with a rubber material such as ethylene-propylene rubber (EPDM), foam EPDM, or foam urethane.

Due to a recording medium passing by a portion where the roller-like member presses against the photosensitive drum 17 (a transfer nip portion), the toner image on the surface of the photosensitive drum 17 is transferred to the recording medium. An unshown power source that applies voltage to the transfer apparatus 24 is connected to the transfer apparatus 24. A voltage with a polarity opposite to the charging polarity of the toner that constitutes the toner image is applied to the transfer apparatus 24 by the power source. Thus, the toner image can be transferred to the recording medium.

The cleaning apparatus 26 cleans the surface of the photosensitive drum 17 after the toner image has been transferred, and is provided with an unshown cleaning blade and an unshown toner accumulation tank. The cleaning blade is a plate-like member whose long direction extends in the axis line direction of the photosensitive drum 17. One end of the cleaning blade in the short direction is supported, and a free end in the short direction contacts the surface of the photosensitive drum 17. Thus, toner, paper dust, or the like that remains on the surface of the photosensitive drum 17 after the toner image has been transferred to the recording medium can be removed from the surface of the photosensitive drum 17. The toner accumulation tank is a container-like member having an internal space, and temporarily accumulates toner that has been removed by the cleaning blade.

The fixing apparatus 23 is provided with a fixing roller 32 and a pressure roller 33. The fixing roller 32 is supported so as to be rotatable around an axis line by an unshown support member. The fixing roller 32 is rotationally driven by the unshown drive means. Also, inside of the fixing roller 32 is an unshown heating member. Thus, the unfixed toner image on the recording medium transported from the transfer nip portion can be heated to melt and fix the toner image on the recording medium.

As the fixing roller 32, for example, it is possible to use a roller having a metal core and an elastic layer. The metal core can ordinarily be formed from a metal such as iron, stainless steel, or aluminum. The elastic layer can be formed with, for example, an elastic material such as silicone rubber or fluorocarbon rubber. The heating member generates heat due to receiving application of voltage from an unshown power source. As the heating member, for example, it is possible to use a heat source such as a halogen lamp or an infrared lamp.

The pressure roller 33 is supported by an unshown pressing support member so as to be capable of rotating around an axis line, and presses against the fixing roller 32. Also, along with rotation of the fixing roller 32, the pressure roller 33 idly rotates while pressing toward the fixing roller 32.

Further, at the fixing nip portion where the pressure roller 33 presses against the fixing roller 32, when the fixing roller 32 fixes the toner image to the recording medium with heat, the pressure roller 33 facilitates fixing of the toner image to the recording medium by pressing the toner in a melted state against the fixing roller 32, via the recording medium. As the pressure roller 33, for example, a roller with the same configuration as the fixing roller 32 may be used. That is, a heating member may also be provided inside of the pressure roller 33. As the heating member, for example, it is possible to use a member that is the same as the heating member inside of the fixing roller 32.

In the fixing apparatus 23, when a recording medium to which a toner image has been transferred passes by the fixing nip portion, the toner that constitutes the toner image is melted and presses against the recording medium, and thus the toner image is fixed to the recording medium. The recording medium on which the toner image has been fixed is discharged to a discharge tray 29 via a plurality of discharge roller pairs 28.

In addition to the configuration described above, the image forming apparatus 30 shown in FIG. 8 is provided with a paper cassette 21, the discharge tray 29, and the scanner unit 31.

The paper cassette 21 is a tray that stores recording media such as ordinary paper, coated paper, color copy paper, overhead projector film, or the like. Using an unshown pickup roller, a paper supply roller pair 27, and a registration roller pair 34, in synchronization with the toner image on the surface of the photosensitive drum 17 transported to the transfer nip portion, the paper cassette 21 supplies recording media sheet by sheet.

The scanner unit 31 is provided with an unshown original placement tray, an original transport mechanism such as a reversing automatic document feeder (RADF), and an original capture apparatus 40.

The reversing automatic document feeder transports an original that has been placed on the original placement tray to an original placement stage 41 of the original capture apparatus 40. The original capture apparatus 40 is provided with the original placement stage 41, an original scanning apparatus 42, a reflecting member 46, an optical lens 50, and a photoelectric transducer line sensor (for example, a CCD (charge coupled device)) 47, and captures image information of the original placed on the original placement stage 41 for each of a plurality of lines (for example, each 10 lines) with the original scanning apparatus 42.

The original placement stage 41 has a glass plate-like member 43 for placing an original whose image information will be captured. The original scanning apparatus 42 is provided with a light source 44, and a first reflecting mirror 45. The original scanning apparatus 42 moves back and forth at a constant velocity V parallel to the bottom face in the perpendicular direction of the original placement stage 41, and irradiates light to the original placed on the original placement stage 41, and due to the light irradiation a reflected light image is obtained. The light source 44 irradiates light to the surface of the original placed on the original placement stage 41. The first reflecting mirror 45 reflects the reflected light image from the original surface towards the reflecting member 46.

The reflecting member 46 is provided with a second reflecting mirror 48 and a third reflecting mirror 49, and forms the reflected light image from the first reflecting mirror 45 on the photoelectric transducer line sensor 47. Also, the reflecting member 46 moves back and forth at a velocity of V/2, following the back and forth movement of the original scanning apparatus 42. The second reflecting mirror 48 and the third reflecting mirror 49 reflect that reflected light image from the first reflecting mirror 45 such that the reflected light image is reflected toward the optical lens 50.

The optical lens 50 forms the reflected light image from the second reflecting mirror 48 and the third reflecting mirror 49 on the photoelectric transducer line sensor 47.

The photoelectric transducer line sensor 47 is provided with an unshown CCD circuit that photoelectrically converts the reflected light image formed by the optical lens 50 into an electrical signal. The photoelectric transducer line sensor 47 outputs the electrical signal, which is image information, to an image processing portion in the control means.

The image processing portion converts image information input from the original capture apparatus 40 or an external device such as a personal computer into an electrical signal, and outputs that electrical signal to the exposure apparatus 22.

In the image forming apparatus 30 described above, it is possible to effectively suppress dirtying of the toner cartridge 10 due to toner leakage, and workability of exchanging the toner cartridge 10 is excellent, so it is possible to make scattering of toner less likely when installing the toner cartridge 10 in the image forming apparatus 30, and thus the toner cartridge 10 can easily be installed in a clean environment.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A toner cartridge installed in an image forming apparatus, the toner cartridge comprising:

a toner storage container that has a toner discharge port;

a toner discharge roller disposed inside of the toner storage container so as to block the toner discharge port; and a seal member, wherein an inner wall of the toner storage container faced by the toner discharge roller is provided with a curved region that has a curvature that matches a curvature of the toner discharge roller, an angle θ satisfies a relationship $20° \leqq \theta \leqq 180°$ in the curved region of the toner storage container, the angle θ being formed by a first imaginary line that connects a curvature start position of one side in a rotation direction of the toner discharge roller with a center of rotation of the toner discharge roller, and a second imaginary line that connects a curvature end position of other side in the rotation direction of the toner discharge roller with the center of rotation of the toner discharge roller, one end of the seal member is fixed to the inner wall of the toner storage container on a downstream side in the rotation direction of the toner discharge roller using the toner discharge port as a reference, and a free end side is inserted between the curved region and the toner discharge roller so as to cover the toner discharge port, the free end side of the seal member is separated from the toner discharge port by a rotation of the toner discharge roller, and the seal member is disposed in a state folded back in the inner wall of the toner storage container, and after the free end side of the seal member is evacuated from the toner discharge port by rotation of the toner discharge roller and released to the outside from between the inner wall of the toner storage container and the toner discharge roller, the seal member is in a state of being not folded back.

2. The toner cartridge according to claim 1, wherein the seal member is made of urethane rubber with a thickness of not less than 0.125 mm and not more than 0.2 mm.

3. The toner cartridge according to claim 1, wherein the toner discharge roller, or at least a surface of the toner discharge roller is formed of a foam elastomer.

4. An image forming apparatus, comprising:

a toner cartridge according to claim 1;

an electrostatic latent image carrier on whose surface an electrostatic latent image is formed;

a charging apparatus that charges the surface of the electrostatic latent image carrier;

an exposure apparatus that forms an electrostatic latent image on the surface of the electrostatic latent image carrier;

a development apparatus that supplies a toner to an electrostatic latent image on the surface of the electrostatic latent image carrier to form a toner image;

a transfer apparatus that transfers a toner image on the surface of the electrostatic latent image carrier to a recording medium;

a cleaning apparatus that cleans the surface of the electrostatic latent image carrier; and a fixing apparatus that fixes a toner image to a recording medium, wherein the image forming apparatus forms an image using an electrophotographic method.

* * * * *